United States Patent [19]

Rivere

[11] 4,048,479

[45] Sept. 13, 1977

[54] OPTIMUM AIR/FUEL MIXTURE COMPUTER FOR INTERNAL COMBUSTION ENGINES

[75] Inventor: Jean-Pierre Rivére, Boulogne-Billancourt, France

[73] Assignee: Regie Nationale des Usines Renault, Boulogne-Billancourt, France

[21] Appl. No.: 691,209

[22] Filed: May 28, 1976

[30] Foreign Application Priority Data

May 29, 1975 France ..... 75.16751

[51] Int. Cl.[2] ..... F02M 7/00; G06G 7/70

[52] U.S. Cl. ..... 235/150.21; 123/32 EA

[58] Field of Search ..... 235/150.21, 150.2, 151.34; 123/32 AE, 32 EA, 97 R, 102, 22

[56] References Cited

U.S. PATENT DOCUMENTS

| | | | |
|---|---|---|---|
| 3,548,792 | 12/1970 | Palmer et al. | 235/150.21 UX |
| 3,815,561 | 6/1974 | Seitz | 235/150.21 X |
| 3,916,170 | 10/1975 | Norimatsu et al. | 235/150.21 |
| 3,927,304 | 12/1975 | Wentworth et al. | 235/150.21 |
| 3,991,727 | 11/1976 | Kawai et al. | 235/150.21 X |

*Primary Examiner*—Joseph F. Ruggiero
*Attorney, Agent, or Firm*—Fleit & Jacobson

[57] ABSTRACT

In a computer for calculating the optimum mixture of combustion agent and fuel for an internal combustion engine, of the type comprising a monostable univibrator operating in synchronism with the rotational velocity of the engine and generating electric pulses of a width subordinate to the value of the voltage measured by a probe for making the chemical analysis of the gases in the exhaust manifold, the thus measured voltage being processed in a regulator provided with an intermediate integrator, said electric pulses being utilized for determining the opening time of a solenoid valve controlling the output of a fluid, whether combustion agent or fuel, of which the metering is measured by said probe, provision is made of a bistable univibrator coupled at one end to the output of a first comparator having one input connected to said chemical analysis probe via an integration type regulating circuit, said univibrator being connected at its other input to a pulse generator opening in synchronism with the rotational movement of the engine, by one of its outputs to an integrator comprising a current amplifier in series with a capacitor and connected to the second input of said first comparator, said one output being also connected to the device controlling the opening time of said solenoid valve, and by its other output to one input of a discharge device for said capacitor.

9 Claims, 7 Drawing Figures

OPTIMUM AIR/FUEL MIXTURE COMPUTER FOR INTERNAL COMBUSTION ENGINES

This invention relates to an improved computer for determining under all circumstances the optimum mixture of combustion agent and fuel for an internal combustion engine operating with a single fuel type.

Various prior art propositions in this field utilize as input parameters the engine rotational velocity and the data supplied by a probe located within the exhaust manifold for obtaining a chemical analysis of the exhaust gases, for instance with a view to determine the amount of residual oxygen.

In a first known system (French Pat. No. 2,035,177) a monostable flip-flop or univibrator operates in synchronism with the rotational movement of the petrol engine to generate pulses delivered to means capable of modulating the pulse width, the modulator control signal being responsive to the negative air pressure in the induction manifold and to a recorder responsive to the carbon monoxide and/or oxygen content of the gaseous mixture; said recorder being mounted in the exhaust gas manifold or pipe and adapted to generate a voltage increasing with said content and corrected as a function of the signal delivered by a thermocouple located in close vicinity of the toxic gas recorder. The width of the generated pulses controls for instance the time period during which a throttling valve mounted in an additional air conduit is open.

In another known system (French Pat. No. 2,238,049) an injection valve inserted in the induction manifold or pipe of the engine is open during the unstable period of a monostable univibrator, which period is subordinate to the pressure prevailing in the induction manifold or pipe and to the analysis of the exhaust gases by a probe inserted in the exhaust system which controls said monostable univibrator through a threshold switch and an integrating regulator, said monostable univibrator being released in synchronism with the rotational velocity of the engine.

These known arrangements are not fully satisfactory in actual practice for they do not properly take into account the fact that the probe constitute a non-linear pick-up or sensor having a high internal impedance of which the voltage characteristic curve as a function of the recorded oxygen content has the shape of a portion of a parabola contained in the first face of the OX positive, OY positive coordinates.

On the other hand, one of the difficulties encountered when attempting to obtain a high-quality servo action resides in a proper compensation of the time required for the transient phenomena to be transmitted through the corrector loop or circuit.

It is the essential object of the present invention to provide improved means whereby the above-mentioned inconveniences can be avoided.

These improved means comprise essentially a computer for calculating the optimum mixture of combustion agent (oxidizer or combustive) and fuel for an internal combustion engine, which comprises a univibrator operating in synchronism with the engine rotational velocity, which is capable of generating pulses of a width depending at least on the value of the voltage sensed by a probe constantly analyzing the gases in the exhaust pipe or manifold, the voltage thus measured being processed in a regulator of the intermediate integration type, the pulses thus generated being utilized for determining the opening time of a solenoid valve controlling the output of a fluid the metering of which is measured by said probe, this computer being characterized in that it comprises a bistable univibrator having one of its inputs connected to the output of a first comparator having in turn one input connected via an integrating regulator circuit to said chemical analysis probe, the other input of said bistable univibrator being connected to a pulse generator operating in synchronism with the rotational movement of the engine, one output of said bistable univibrator being connected to a first integrator comprising a current amplifier in series with a capacitor connected to the other input of said first comparator, said one output being also connected to the device controlling the opening time of said solenoid valve, the other output of said bistable univibrator being connected to one input of a discharge circuit of said capacitor.

This computer may be so arranged that when no measurement is made by the non-linear sensor the solenoid valve opening time remains constant, this time being adapted to be modulated by the measurement made by said non-linear sensor.

Other features and advantages of this invention will appear as the following description proceeds with reference to the attached drawings, in which.

Figure 1:
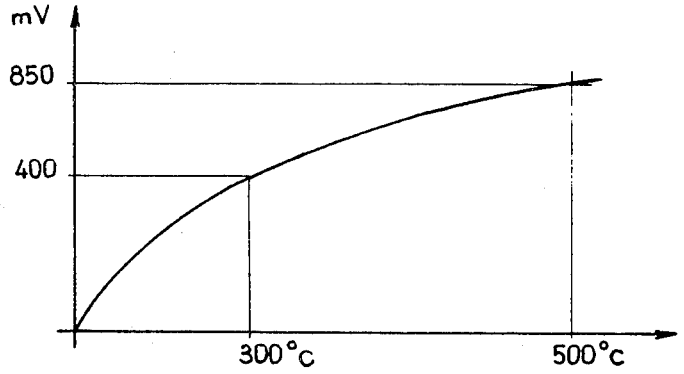
FIG. 1 illustrates in diagram form the variation of the maximum voltage of a probe as a function of temperature.

Referring first to FIG. 1, in the curve illustrated the maximum probe voltage is plotted against the probe temperature. This curve has a parabolic shape and probes that the probe is a non-linear sensor.

Figure 3C:
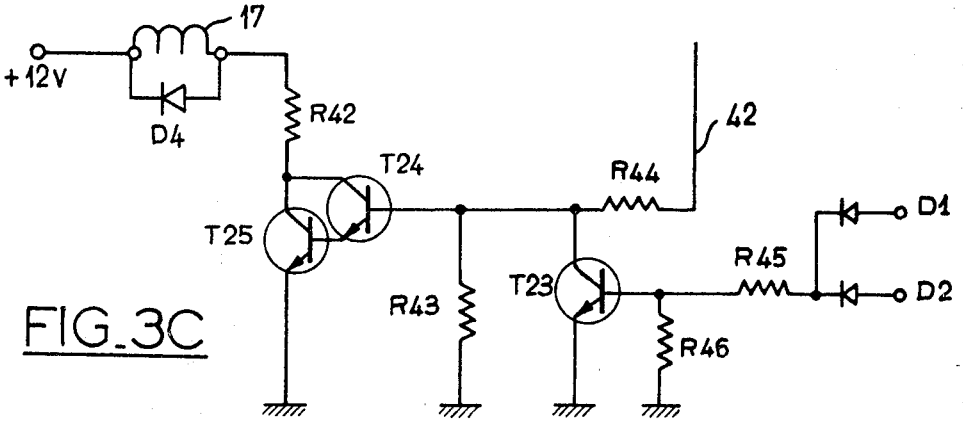
FIGS. 3A, 3B and 3C illustrate a detailed form of embodiment of the computer of FIG. 2.
Figure 2:
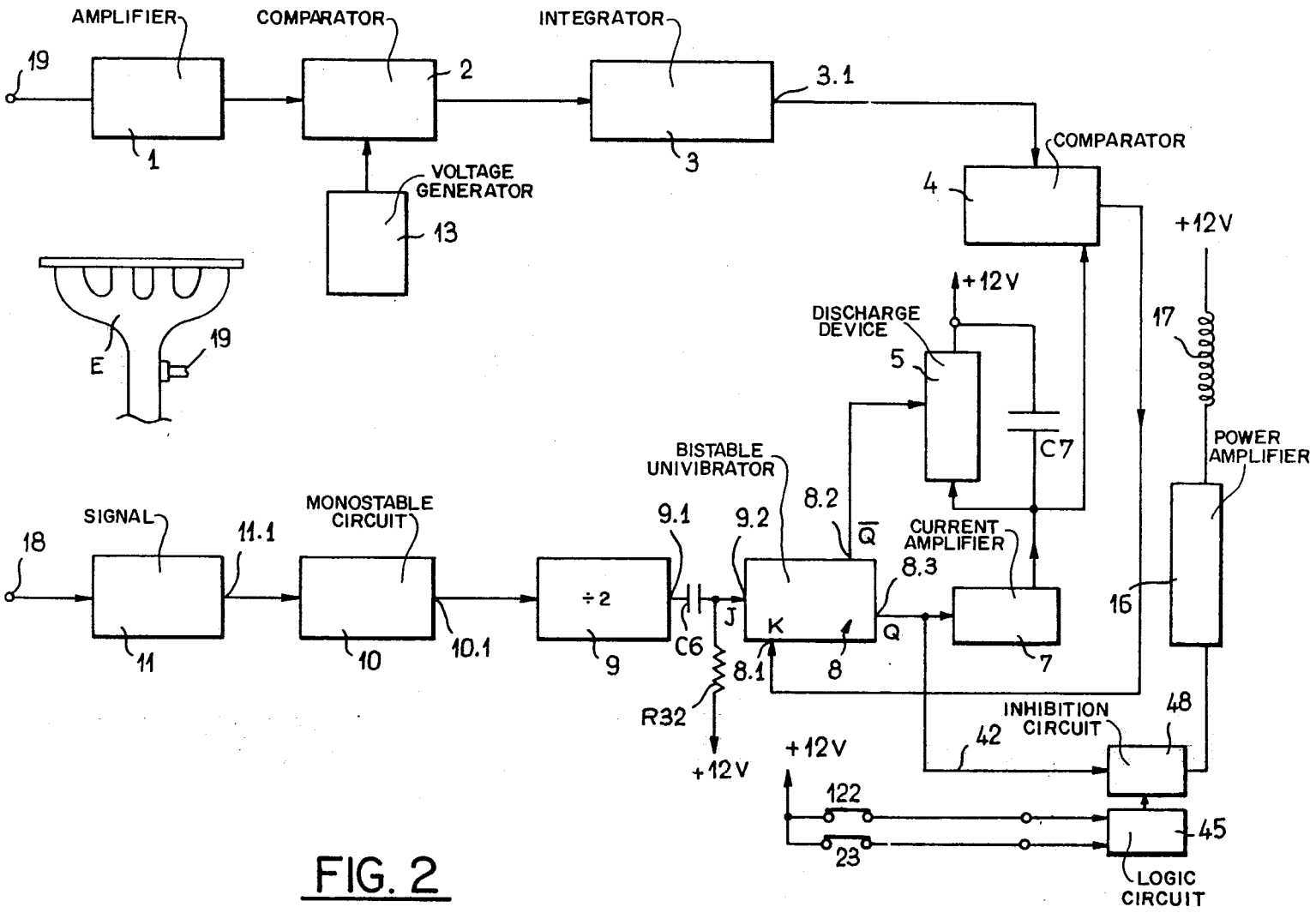
FIG. 2 is a block diagram illustrating a typical form of embodiment of the computer of this invention.

In the form of embodiment shown in FIG. 2 a probe, sensor or like device 19 for analyzing the chemical composition of the gases in the exhaust manifold E, for example for detecting the amount of residual oxygen therein, is connected to an amplifier 1 connected in turn to a first comparator 2 and to a first integrator 3. The first comparator 2 is connected via a second input to a reference voltage generator 13. One terminal 18 of a breaker is connected to one input $9_2$ of a bistable univibrator 8 via the series connection of a circuit for shaping the signal 11, a monostable circuit 10 and a divider by two circuit 9. The other input $8_1$ of said bistable univibrator 8 is coupled to the output of a second comparator 4 having one input connected to the output 3.1 of the first integrator 3 and its other input connected to a second integrator comprising a current amplifier 7, a capacitor C7 and a device 5 for discharging this integrator. One output 8.9 or $\overline{Q}$ of the bistable univibrator 8 is connected on the one hand to the input of the current amplifier 7 of the second integrator C7 and on the other hand to the coil 17 of a solenoid valve adapted to inject air downstream of the gas throttle via a conductor 42 and a power amplifier 16. Inserted in this conductor 42, as will be explained presently with reference to FIG. 3C, is an inhibition circuit 48 controlled by an inhibition control logic circuit 45 comprising on the one hand an OR gate having its inputs connected to the positive terminal of a supply battery via a thermal switch 122 fitted to the cylinder-head of the engine as a protection device when starting a cold engine and on the other hand a switch 23 closed when the driver releases the accelerator pedal, respectively.

The signal from the breaker 18 is shaped in circuit 11 and restored to a logic level. The shaping may be completed by the monostable circuit 10 by calibrating the signal width and eliminating strays caused primarily by possible rebounds of the breaker. The function of the divider 9 adapted to divide the frequency by two is to increase the useful life of the coil 17 of the solenoid valve. The bistable univibrator 8 controls the power stage 16. One input of said univibrator 8 is monitored by the signal from the output of said divider by two, the other input being monitored as a function of a signal from the probe 19.

The probe amplifier 1 is a high input impedance amplifier permitting an easy adaptation to the probe 19. The comparator stage 2 is adapted to compare the data supplied by the probe with an adjustable reference voltage 13.

The first integrator stage 3 is designed for charging and discharging a capacitor as a function of the information received from stage 2. The second stage of comparator 4 compares the output signal from integrator 3 with the charge of capacitor C7. The output of comparator stage 4 is adapted to monitor the discharge of capacitor C7, whose charge is monitored by the information from the divider by two 9. The solenoid 17 controlling the air injection valve is energized when the capacitor C7 is charged through the power amplifier 16 receiving the signal transmitted by conductor 42, provided that this conductor is not inhibited by the inhibition circuit 48 capable of neutralizing the passage of said signal through the medium of the logic OR gate having two inputs connected to the thermal switch 122 preventing the operation of the servo means when the engine is cold, for example until the engine cooling fluid has reached a temperature of about 45° C, and to the accelerator pedal release switch 23, respectively. The low-level control signal of the coil 17 of said solenoid valve is received from the output Q of bistable univibrator 8.

Now a more detailed form of embodiment illustrated in FIGS. 3A, 3B and 3C will be described with reference to the signal waveform shown in FIG. 5, in which the time scale of lines 7 and 8 is reduced to one-hundredth of the scale of the other lines by way of illustration. The same reference numerals designate the same components in the various Figures.

Figure 3A:
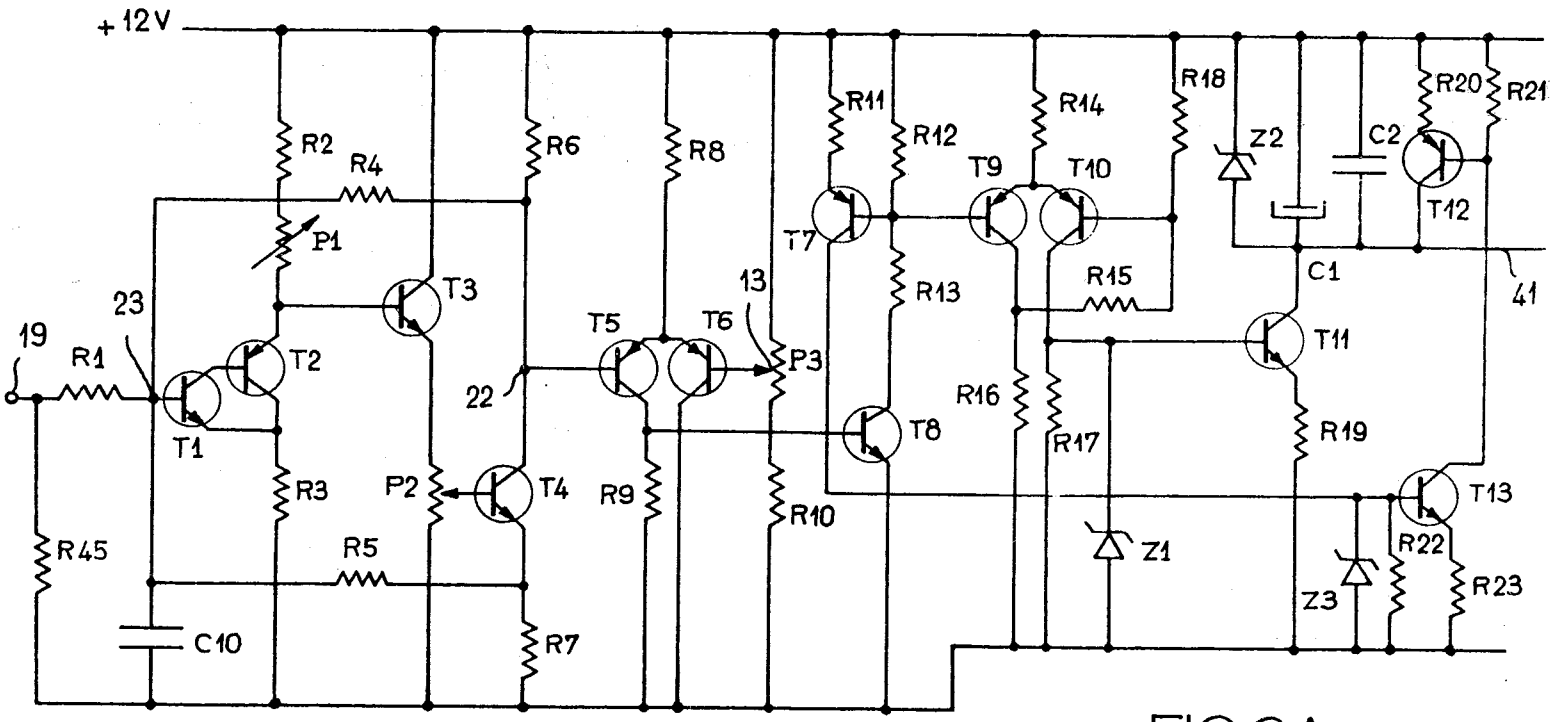

In the form of embodiment illustrated in FIG. 3A, the signal obtained at 19 from the sensor-forming probe is amplified by four transistors T1, T2, T3 and T4. The output signal 22 has the same direction as the signal picked up by the probe. Transistors T1 and T2 are arranged according to the well-known Darlington mounting so as to have a relatively high input impedance. A potentiometer P2 is provided for adjusting the output voltage deviation. Resistors R4 and R5 connected to the collector and emitter respectively of transistor T4, on the one hand, to the base of transistor T1, on the other hand, are adapted to restore a current at the base of the input transistor, so that the probe output can be stopped and the input impedance of the circuit can be increased. Resistors R4 and R5, associated with resistors R6 and R7 connected to the collector and emitter, respectively, of transistor T4, constitute a bridge for biasing the input amplifier 1, thus yielding a relatively high voltage under no-load conditions at the base 23 of input transistor T1. This voltage can be further reduced through another resistor R45 constituting a divider bridge with resistor R1 connected to the base 23 of transistor T1. A capacitor C10 is provided for filtering the input signal to amplifier 1.

The voltage obtained at the output 22 of this amplifier is fed to the base of a transistor T5 forming with another transistor T6 the comparator 2 of FIG. 1. The reference voltage 13 of this comparator is adjusted by means of a potentiometer P3. Then the integrating stage 3 is attained which operates as follows:

When the output voltage measured at 22 is higher than the reference voltage 13, transistor 5 is not conducting and the voltage across the terminals of a resistor R9 coupled to the collector of transistor T5 is zero. Another transistor T8 having its base connected across the terminals of resistance R9 is blocked. The same applies to a further transistor T9 having its base coupled to the collector of transistor T8. A transistor T10 connected with T9 to the comparator has its base coupled on the one hand to the plus terminal of the circuit via a resistor R18 and on the other hand to the collector of transistor T9 via another resistor R15. The collector of transistor T9 being on the other hand grounded via a resistor R16, the base voltage of transistor T10 is set by the bridge-forming set of resistors R18, R15 and R16. In this case, transistor T10 is conducting and the same applies to a transistor T11 having its base coupled to the collector of transistor T10 and grounded via a Zener diode Z1. The collector of this transistor T11 is connected to the positive terminal or side of the circuit via a parallel connection comprising a Zener diode Z2, a capacitor C1, a capacitor C2 and the series connection of the collector-to-emitter gap of a transistor T12, and a resistor R20. The base of transistor T12 is coupled to the positive terminal or side of the circuit via a resistor R21, and grounded via the collector-to-emitter gap of a further transistor T13 and a resistor R23. The base of transistor T13 is on the one hand grounded via a parallel connection between a Zener diode Z3 and a resistor R22, and on the other hand to the positive terminal of the circuit via the collector-to-emitter gap of a transistor T7, and a resistor R11. The base of transistor T7 is connected to the base of transistor T9 and to the junction point of a pair of resistors R12 and R13 disposed in series with the collector of transistor T8. When transistor T11 is conducting, as in the preceding hypothesis, the capacitor C1 is charged, the Zener diode Z1 limits the voltage at the base of transistor T11 and the other Zener diode Z2 limits the value of the charge of capacitor C1 to permit the operation of the second comparator 4 (FIG. 2) comprising transistors T21, T22 (on the right-hand portion of FIG. 3B), for otherwise the voltage level at the base of transistor T22 connected to the collector of transistors T11 and T12 via a conductor 41 would remain lower than the voltage level obtained at the base of transistor T21, and the operation to be described presently would be impaired.

In the second hypothesis in which the voltage at the output 22 of amplifier 1 becomes lower than the reference voltage 13, transistor T5 is conducting. Thus, a voltage appears across the terminals of resistor R9 and transistor T8 is also conducting, the potential at the junction point of resistors R12 and R13 decreases and the pair of transistors T9 and T7 are conducting as well as transistors T13 and T12. Capacitor C1 is then discharged through transistor T12 and resistor R20.

In the first hypothesis, the output voltage fed to conductor 41 decreases and in the second hypothesis this voltage increases, these voltage variations being related to those of the probe with respect to the reference voltage 13 fed to P3. The charging and discharging rates of capacitor C1 are determined by the values of resistors R19 and R20, with a view to obtain the same slope under both charging and discharging conditions. The Zener diode Z3 has the same function as the Zener diode Z1 and limits the voltage at the base of transistor T13.

Figure 3B:
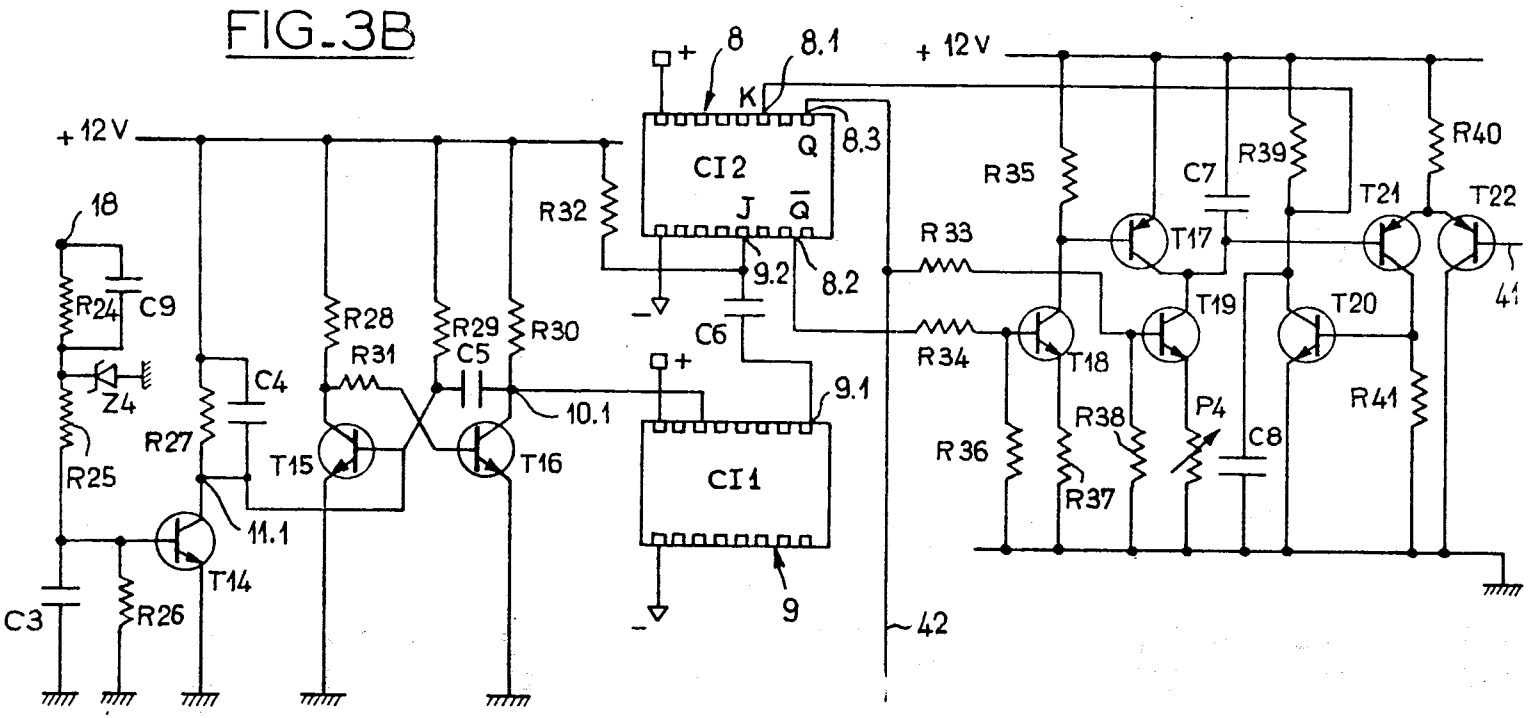

As shown in FIG. 3B, a transistor T14 has its base coupled to the breaker 18 via a pair of series-connected resistors R24 and R25, and also through the parallel connection, between said base and the ground, of another Zener diode Z4, in order to limit the signal generated by said breaker, of a capacitor C3 and of a resistor R26. A capacitor C9 is connected in parallel with resistor R26. In FIG. 5, the first line (1) shows the waveform of the signal emitted from said breaker 18. The assembly of elements connected to the base of transistor T14 is used for filtering the signal. Associated with the shaping circuit thus constituted are transistors T15 and T16 forming in conjunction with resistors R27 to R30 and capacitors C4, C5 a monostable univibrator for gauging the signal in the longitudinal direction. Lines 2 and 3 of FIG. 5 illustrate the signal waveform at points 11.1 and 10.1, respectively, of FIG. 3B. Point 10.1 on the collector of transistor T16 constituting the output of monostable univibrator 10 is connected to an integrated circuit C11 constituting the divider by two 9 of FIG. 2. This divider by two consists of a monostable univibrator JK for tilting on the downward edges of the input signal. FIG. 5 illustrates in line 4 the signal waveform at the output 9.1 of the divider by two. The output 9.1 of integrated circuit C11 is fed to the gate J of bistable univibrator 8 comprising a second integrated circuit C12 through the medium of a differentiating circuit comprising in turn a capacitor C6 in series with a resistor R32 leading to the positive terminal. This differentiating circuit is advantageous in that only every other active control peak is used, thus avoiding any pulse overlapping at the input J according to the mode of operation to be described presently.

The second integrated circuit C12 corresponds to the bistable univibrator 8 of FIG. 2. It is a univibrator of the JK type operating on the descending edges of the control signals. The condition of outputs Q (8.3) and $\overline{Q}$ (8.2) is modified by the negative pulses received alternatively by the inputs J (9.2) and K (8.1). A negative pulse fed to input (9.2) brings the output Q (8.3) to logic level one, which is fed to the base of a transistor T19. This transistor T19 is thus caused to conduct and charges the capacitor C7 in series with its collector circuit. The potential at the base of a transistor T21 connected to said capacitor C7 will thus decrease, as illustrated in line 9 of FIG. 5, and when the potential at the base of transistor T21 drops below that fed to the base of transistor T22, of which the evolution is shown in line 8 of FIG. 5, said transistor T21 is saturated. Considering the difference between the time scales of the aforesaid lines 7 and 8 with respect to the other lines, the potential to which reference should be made on the base of transistor T21 to make the latter conducting is in fact very close to that existing on the base of transistor T22 when the aforesaid negative pulse is fed to input J (9.2) of the univibrator, and this accounts for the pattern of said line 9 in FIG. 5. When transistor T21 is conducting, a voltage appears across the terminals of a resistor R41 coupled to the collector of transistor T21, and transistor T20 becomes saturated since its base is connected to one terminal of resistor R41. The potential available at the collector of transistor T20 drops to zero, thus causing a negative reactive compulsion to be emitted from the input K (8.1) of univibrator C12, as illustrated in line 6 of FIG. 5. Thus, the output $\overline{Q}$ (8.2) assumes the logic level one and the output Q (8.3) assumes the logic level 0. At the same time, a transistor T18 having its base connected to the output $\overline{Q}$ is saturated together with another transistor T17 having its base connected to the collector of transistor T18. The capacitor C7 is thus short-circuited by said saturated transistor T17 and therefore discharged instantaneously by this transistor T17 as illustrated in line 9 of FIG. 5. The width of the signal obtained at the outputs Q (8.3) and $\overline{Q}$ (8.2) is thus proportional to the voltage variations of the probe 19 in relation to the reference voltage 13, since the resetting of the monostable univibrator C12 is controlled by the comparator 4 comprising transistors T21 and T22. When the probe voltage is higher than said voltage 13, the width of the square wave increases gradually and when this voltage is lower than voltage 13, the width of the square wave decreases gradually.

Figure 5:
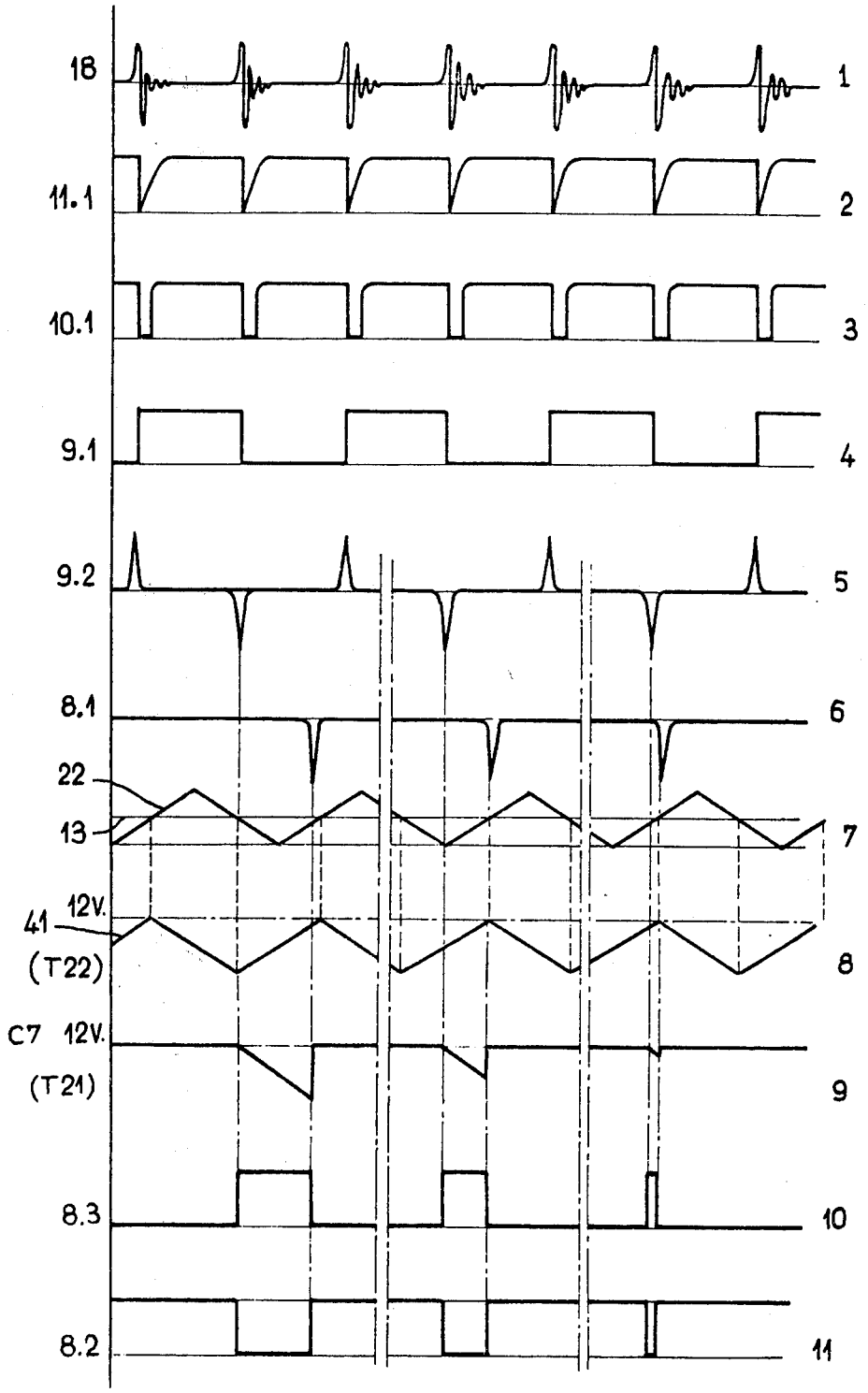

A potentiometer P4 is coupled to the emitter of transistor T19 for regulating the charging current of capacitor C7 and therefore the charging rate of this capacitor C7 as well as the width of the square waves obtained, as illustrated in lines 10 and 11 of FIG. 5.

The control signal fed to the solenoid valve is directly proportional to the width of square waves Q and $\overline{Q}$.

From the foregoing it is clear that, as a rule, the optimum air/fuel mixture computer according to this invention, inserted between the probe 19 and the solenoid valve 17 controlling the opening of the auxiliary air passage leading to the induction manifold downstream of the carburettor for adjusting the richness of the mixture of combustion agent and fuel delivered to the engine, constitutes a closed loop with the probe, the solenoid valve, the carburettor and the engine. This probe 19 operates somewhat like a storage battery of which the voltage is subordinate to the richness of the air/fuel mixture delivered to the engine. With this closed loop, the richness of the mixture delivered to the engine can be varied within very fine limits about an average position that can be preset at will. The potentiometers P3 and P4 (FIGS. 3A and 3B) are set beforehand and definitely as a function of predetermined combustion parameters. Potentiometer P3 is used for setting the reference voltage which causes the regulation means to operate the probe at a predetermined constant richness value whereat it provides at 19 a given voltage, and potentiometer P4 sets the rate of charge of capacitor C7 (FIG. 3B) and therefore the opening time dynamics of the auxiliary air injector.

The output Q (8.3) of the bistable univibrator 8 or C12 is coupled not only to the base of transistor T19 via a resistor R33 but also to the base of a transistor T24 via conductor 42 in which a resistor R44 is inserted (FIG. 3C). Transistor T24 is connected via its emitter to the base of another transistor T25. Both transistors T24 and T25 are connected according to the Darlington mounting to constitute the power amplifier 16 for the coil 17 of said solenoid valve coil. Moreover, a transistor T23 constituting the inhibition circuit 48 of FIG. 2 has its collector-to-emitter gap connected between the resistor R44 and the ground, and the base of this transistor T23 is connected to the OR gate 15 of FIG. 2. This OR gate has one input D1 connected to the back thermal contact 122 preventing the operation of the regulation system of this invention until the engine cooling fluid temperature attains for example 45° C, and another input D2 connected to the release acceleration pedal switch 23. When a wrong information appears at one of these inputs, transistor T23 is saturated. Thus, the base of transistor T24 is re-grounded and the Darlington mounting T24–T25 is blocked.

Figure 4:
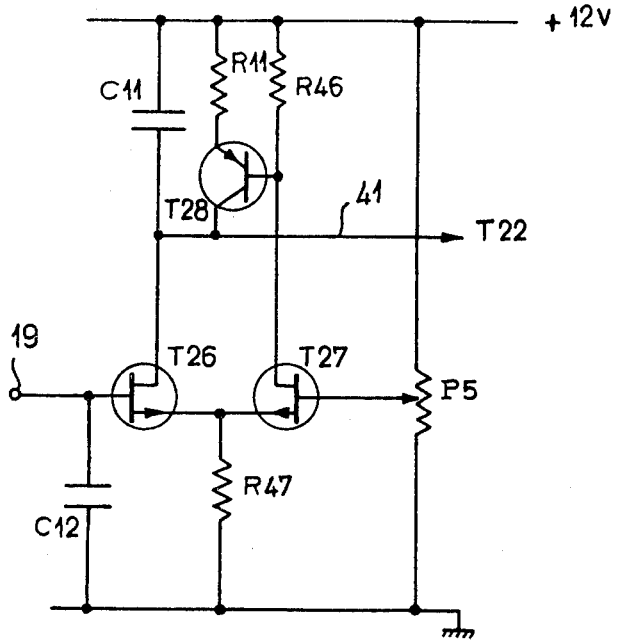
FIG. 4 illustrates a modified form of embodiment of the computer portion illustrated in FIG. 3A; and, FIG. 5 illustrates the waveforms of the voltage obtained at the main points of the form of embodiment of FIGS. 3A, 3B and 3C.

FIG. 4 illustrates a modified form of embodiment of the circuit illustrated in FIG. 3A. In the arrangement of FIG. 4 the first comparator circuit 2 comprises two field-effect transistors T26 and T27.

The probe 19 is connected to the grid of transistor T26 grounded on the other hand via a capacitor C12. The source electrodes of the pair of transistors T26 and T27 are grounded via a resistor R47. The drain electrode of transistor T26 is connected to the positive terminal via a capacitor C11. The junction point between the drain of transistor T26 and capacitor C11 is coupled on the one hand to the base of transistor T22 of FIG. 3B via a conductor 41, and on the other hand to the positive potential of the circuit via the collector-to-emitter gap of a transistor T28 and a series-connected resistor R11. The drain electrode of the field-effect transistor T27 is coupled to the base of transistor T28 and therefore to the positive terminal of the circuit via a resistor R46. The grid of the field effect transistor T27 is coupled to the sliding contact of another potentiometer P5. The circuit of FIG. 4 operates substantially like the circuit of FIG. 3A, the capacitor C11 which corresponds to capacitor C1 being charged when T26 is conducting, and discharged through T28 and R11 when T27 is conducting, this potentiometer P5 being the equivalent of potentiometer P3 and providing the reference voltage.

Although specific forms of embodiment of this invention have been described and illustrated in the accompanying drawings, it will readily occur to those skilled in the art that various modifications and changes may be brought thereto without departing from the scope of the invention as set forth in the appended claims.

What is claimed as new is:

1. In a computer for calculating the optimum mixture of combustion agent and fuel for an internal combustion engine, of the type comprising a monostable univibrator operating in synchronism with the rotational velocity of the engine and generating electric pulses of a width subordinate to the value of the voltage measured by a probe for making the chemical analysis of the gases in the exhaust manifold, the thus measured voltage being processed in a regulator provided with an intermediate integrator, said electric pulses being utilised for determining the opening time of a solenoid valve controlling the output of a fluid, whether combustion agent or fuel, of which the metering is measured by said probe, provision is made of a bistable univibrator coupled at one end to the output of a first comparator having one input connected to said chemical analysis probe via an integration type regulating circuit, said univibrator being connected at its other input to a pulse generator operating in synchronism with the rotational movement of the engine, by one of its outputs to an integrator comprising a current amplifier in series with a capacitor and connected to the second input of said first comparator, said one output being also connected to the device controlling the opening time of said solenoid valve, and by its other output to one input of a discharge device for said capacitor.

2. Computer according to claim 1, wherein said integrating regulator comprises a second comparator connected on the one hand to said probe and on the other hand to a reference voltage generator.

3. Computer according to claim 1, wherein said integrating regulator comprises in succession a probe amplifier, said second comparator and a second integrator, said amplifier of the high impedance type comprising a pair of resistors constituting a double feedback yielding an input potential higher than the residual voltage of an input transistor and a dividing bridge restoring the biasing voltage to a low value across the terminals of said resistor.

4. Computer according to claim 3, wherein said integrator is of the type comprising a capacitor associated with a charge circuit and with a discharge circuit, said second integrator comprising a first transistor connected through its base to the terminals of a resistor inserted in the collector of one of the pair of transistors constituting said second comparator circuit, said first transistor being connected to the positive terminal of the circuit through the series connection of a pair of resistors with its collector, the junction point of said last-mentioned pair of resistors being inserted in the loop circuit comprising said junction point connected to the base of a first transistor having its collector connected to the base of a second transistor having in turn its collector connected to the base of a third transistor having its collector connected in turn to the collector of a fourth transistor having in turn its base connected to the collector of a fifth transistor having its emitter connected to the emitter of a sixth transistor having its base connected to said junction point of said pair of resistors.

5. Computer according to claim 4, wherein the junction point point between the collector of said third and fourth transistors is connected to the high potential side of the circuit via the parallel connection of said integrating capacitor and a Zener diode, the emitter of the third transistor being connected to the high potential side of said circuit via a resistance, the emitter of the fourth transistor being grounded via another resistor whereas the output of the first integrating circuit is connected to the junction point of the collectors of said third and fourth transistors.

6. Computer according to claim 4, wherein the base of the fourth transistor is grounded via a first Zener diode, the base of said second transistor is also grounded but via a second Zener diode, the base of the fifth transistor being connected on the one hand to the high voltage side of the circuit via a first resistor and on the other hand to the collector of the sixth transistor via a second resistor, and a third resistor is connected in series with the collector of the sixth transistor between the junction point of said second resistor and the ground.

7. Computer according to claim 2, wherein said integrating regulator consists of a pair of field-effect transistors mounted as a comparator, one transistor supplying an integration capacitor and the other a transistor for discharging said integrating capacitor.

8. Computer according to claim 2, further comprising a feedback path between the second output and the first input of said bistable univibrator, which comprises a first transistor having its base connected to said second output via a resistor, the emitter of said first transistor comprising an adjustable potentiometer while the collector of said first transistor is connected to the capacitor and to the base of one of said pair of transistors constituting the first comparator, the collector of the base of said one transistor of the pair being connected to the base of a third transistor having its collector connected to the first input of the bistable univibrator.

9. Computer according to claim 4, wherein said univibrator has its first output connected to the base of the transistor of said first comparator via an amplifier comprising a pair of transistors, the junction point between the collector of said first transistor and said capacitor of said first integrator being connected to the collector of the second transistor of said amplifier, whereas the emitter of this second transistor is connected to the high voltage side of said circuit, whereby the second transistor constitutes the discharge circuit of said capacitor.

* * * * *